US010736806B2

(12) United States Patent
Tan et al.

(10) Patent No.: US 10,736,806 B2
(45) Date of Patent: Aug. 11, 2020

(54) MASSAGE CHAIR AND METHOD OF DRIVING THE SAME

(71) Applicants: OSIM INTERNATIONAL LTD, Singapore (SG); DAITO ELECTRIC MACHINE INDUSTRY CO., LTD, Osaka (JP)

(72) Inventors: Kia Tong Tan, Singapore (SG); Tsuyoshi Sato, Kanagawa (JP); Yasushi Sone, Kasai shi Hyogo (JP)

(73) Assignees: OSIM INTERNATIONAL LTD (SG); DAITO ELECTRIC MACHINE INDUSTRY CO., LTD (JP)

( * ) Notice: Subject to any disclaimer, the term of this patent is extended or adjusted under 35 U.S.C. 154(b) by 550 days.

(21) Appl. No.: 15/121,350

(22) PCT Filed: Feb. 27, 2015

(86) PCT No.: PCT/SG2015/000063

§ 371 (c)(1),
(2) Date: Aug. 24, 2016

(87) PCT Pub. No.: WO2015/130232

PCT Pub. Date: Sep. 3, 2015

(65) Prior Publication Data

US 2016/0374885 A1 Dec. 29, 2016

(30) Foreign Application Priority Data

Feb. 27, 2014 (JP) ..... 2014-036913
Jul. 11, 2014 (JP) ..... 2014-143214
Oct. 6, 2014 (JP) ..... 2014-205696

(51) Int. Cl.
*A61H 1/00* (2006.01)
*A61H 23/00* (2006.01)
(Continued)

(52) U.S. Cl.
CPC ..... *A61H 1/008* (2013.01); *A47C 1/024* (2013.01); *A47C 7/54* (2013.01); *A61H 7/007* (2013.01);
(Continued)

(58) Field of Classification Search
CPC ..... A47C 1/024; A47C 7/54; A61H 1/008; A61H 23/006; A61H 7/007; A61H 15/00;
(Continued)

(56) References Cited

U.S. PATENT DOCUMENTS 5,575,761 A * 11/1996 Hajianpour ..... A61H 23/0263 601/48
6,087,942 A * 7/2000 Sleichter, III ..... B60N 2/976 340/576
(Continued)

FOREIGN PATENT DOCUMENTS

CN 1170568 A 1/1998
CN 1178102 A 4/1998
(Continued)

OTHER PUBLICATIONS

Office Action issued for Chinese Application No. 201580011037.7 dated Apr. 13, 2018, 5 pgs.
(Continued)

*Primary Examiner* — Tu A Vo
*Assistant Examiner* — Alexander Morales
(74) *Attorney, Agent, or Firm* — Baker & McKenzie LLP

(57) ABSTRACT

A massage chair includes a backrest, and two sets of massage arms assembled with the backrest and spaced apart from each other along a transversal axis of the backrest, each set including a first and a second massage arm that respectively have a first and a second contact member and are movable relative to each other. The method includes positioning the two sets of the massage arms such that at least the
(Continued)

first contact members of the first massage arms contact a desired region of a user's body, actuating the two sets of the massage arms to perform a sequence of kneading pulses or a continuous kneading displacement from a wide state to a narrow state to apply a gripping action on the user's body, and stopping the two sets of the massage arms in the narrow state for a period of time to maintain the gripping action on the user's body.

19 Claims, 18 Drawing Sheets

(51) Int. Cl.

| | |
|---|---|
| ***A61H 7/00*** | (2006.01) |
| ***A47C 1/024*** | (2006.01) |
| ***A47C 7/54*** | (2006.01) |
| ***A61H 15/00*** | (2006.01) |

(52) U.S. Cl.
CPC ... *A61H 23/006* (2013.01); *A61H 2015/0042* (2013.01); *A61H 2201/0149* (2013.01); *A61H 2201/1215* (2013.01); *A61H 2201/149* (2013.01); *A61H 2201/1623* (2013.01); *A61H 2201/1664* (2013.01); *A61H 2201/1676* (2013.01); *A61H 2201/1678* (2013.01); *A61H 2201/5035* (2013.01); *A61H 2201/5066* (2013.01); *A61H 2230/825* (2013.01)

(58) Field of Classification Search
CPC ..... A61H 2015/0042; A61H 2015/005; A61H 2201/0149; A61H 2201/1664; A61H 2201/5035; A61H 2201/1678; A61H 2201/1215; A61H 2201/1676; A61H 2201/5066; A61H 2201/1623; A61H 2230/825
USPC ..... 601/134, 24, 26, 49, 48, 52, 53, 89, 90, 601/93, 94, 97, 98, 99, 100, 107, 108, 601/110, 111
See application file for complete search history.

(56) References Cited

U.S. PATENT DOCUMENTS

| | | | | |
|---|---|---|---|---|
| 6,224,563 | B1 * | 5/2001 | Nonoue | A61H 15/0078 601/99 |
| 6,511,448 | B1 | 1/2003 | Furuie et al. | |
| 7,731,671 | B2 * | 6/2010 | Ting | A61H 7/007 601/101 |
| 2002/0068887 | A1 * | 6/2002 | Kikumoto | A61H 7/007 601/49 |
| 2002/0123704 | A1 * | 9/2002 | Hori | A61B 5/0533 601/99 |
| 2002/0138023 | A1 * | 9/2002 | Kume | A61H 15/0078 601/99 |
| 2002/0177796 | A1 * | 11/2002 | Suh | A61H 7/001 601/84 |
| 2003/0032903 | A1 * | 2/2003 | Kasai | A61H 1/00 601/99 |
| 2004/0225239 | A1 * | 11/2004 | Yamamoto | A61H 15/0078 601/84 |
| 2004/0243030 | A1 | 12/2004 | Tanizawa et al. | |
| 2006/0111653 | A1 * | 5/2006 | Nishio | A61H 7/001 601/84 |
| 2007/0167887 | A1 | 7/2007 | Tsukada et al. | |
| 2007/0299377 | A1 * | 12/2007 | Shiraishi | A61H 7/007 601/98 |
| 2009/0149784 | A1 | 6/2009 | Morita et al. | |
| 2009/0177128 | A1 * | 7/2009 | Fukuyama | A61H 7/001 601/98 |
| 2010/0081972 | A1 * | 4/2010 | Kan | 601/99 |
| 2011/0144549 | A1 * | 6/2011 | Wu | A61H 7/004 601/84 |

FOREIGN PATENT DOCUMENTS

| | | | |
|---|---|---|---|
| CN | 1660025 | A | 8/2005 |
| CN | 101002711 | A | 7/2007 |
| TW | 200528084 | | 9/2005 |

OTHER PUBLICATIONS

Official Action from Taiwanese Patent Application No. 105105735 dated Feb. 20, 2017.
International Search Report and Written Opinion, PCT/SG2015/000063, dated May 25, 2015, 10 pages.

* cited by examiner

202

MASSAGE CHAIR AND METHOD OF DRIVING THE SAME

This patent application is a national phase filing under section 371 of PCT/SG2015/000063, filed Feb. 27, 2015, which claims priority to Japanese Patent Application No. 2014-036913, filed Feb. 27, 2014, Japanese Patent Application No. 2014-143214, filed Jul. 11, 2014 and Japanese Patent Application No. 2014-205696, filed Oct. 6, 2014, each of which is incorporated herein by reference in its entirety.

BACKGROUND

1. Field of the Invention

The present invention generally relates to a massage chair and methods of driving the massage chair. For example, a method of massaging using the massage chair.

2. Description of the Related Art

Massage apparatuses currently available on the market include massage chairs equipped with a massage member capable of applying diverse types of massage actions on a user's body. Typically, the massage apparatuses are designed to simulate massage effect provided by masseurs. According to the needs, a user may select a massage program corresponding to a predetermined combination of movement and pressure actions of the massage member for producing certain desirable relaxing effects. However, the application of the existing programs may not adequately provide satisfactory massage effects on certain regions of the user's body, e.g., shoulders and neck.

Therefore, there is a need for massage apparatuses that can address or improve at least the foregoing issues.

SUMMARY

The present application describes a massage chair and methods of driving the massage chair that can dispense effective massage to reduce stress and relieve pain. In one embodiment, the massage chair includes a backrest, and two sets of massage arms assembled with the backrest and spaced apart from each other along a transversal axis of the backrest, each set including a first and a second massage arm that respectively have a first and a second contact member and are movable relative to each other. The method includes positioning the two sets of the massage arms such that at least the first contact members of the first massage arms contact a desired region of a user's body, actuating the two sets of the massage arms to perform a sequence of kneading pulses or a continuous kneading displacement from a wide state to a narrow state, whereby a gripping action is applied on the user's body when the two sets of the massage arms reach the narrow state, and stopping the two sets of the massage arms in the narrow state for a period of time to maintain the gripping action on the user's body.

In another embodiment, a massage chair is described. The massage chair includes a backrest, two sets of massage arms assembled with the backrest and spaced apart from each other along a transversal axis of the backrest, each set including a first and a second massage arm that are movable relative to each other and respectively have a first and a second contact member, and a microcontroller operable to actuate the two sets of the massage arms. The microcontroller is configured to position the two sets of the massage arms such that at least the first contact members of the first massage arms contact with a desired region of a user's body, actuate the first and second massage arms to perform a sequence of kneading pulses or a continuous kneading displacement from a wide state to a narrow state to apply a gripping action on the user's body, and stop the two sets of the massage arms in the narrow state for a period of time to maintain the gripping action on the user's body.

In yet another embodiment, the massage chair includes a backrest, two sets of massage arms assembled with the backrest and spaced apart from each other along a transversal axis of the backrest, and a microcontroller operable to actuate the massage arms. Each set of the massage arms includes a first and a second massage arm that are movable relative to each other and respectively have a first and a second contact member, the two sets of the massage arms further having a wide state in which the two first contact members are transversally spaced apart from each other by a first distance, and a narrow state in which the two first contact members are transversally spaced apart from each other by a second distance smaller than the first distance. The microcontroller is configured to position the two sets of the massage arms such that at least the first contact members of the first massage arms contact a desired region of a user's body, actuate the two sets of the massage arms to perform a continuous kneading displacement from the wide state to the narrow state with a programmable speed for applying a gripping action on the user's body, and stop the two sets of the massage arms in the narrow state for a period of time to maintain the gripping action on the user's body.

DETAILED DESCRIPTION OF THE EMBODIMENTS

Figure 1:
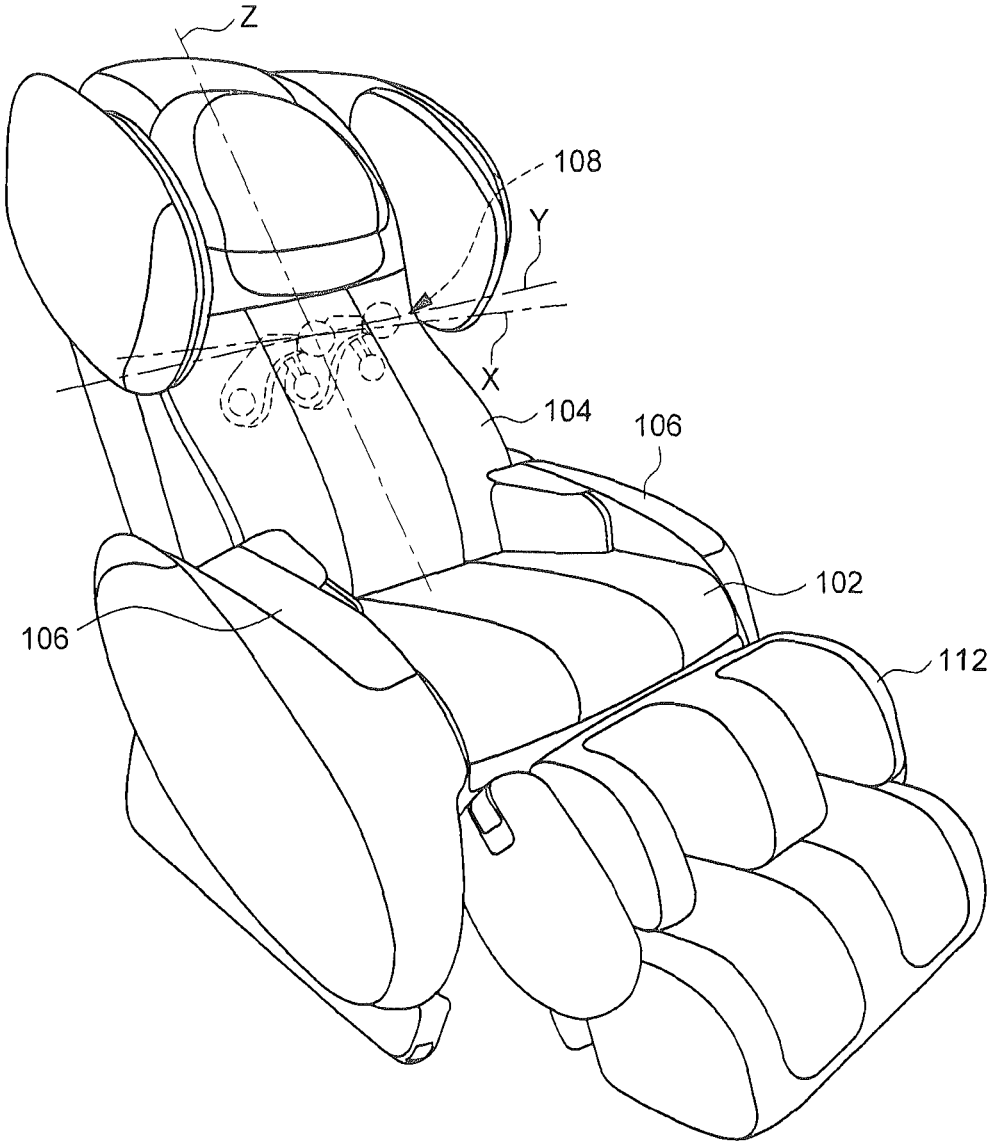
FIG. 1 is a schematic view illustrating an embodiment of a massage chair.

FIG. 1 is a schematic view illustrating an embodiment of a massage chair 100. The massage chair 100 can include a seat 102, a backrest 104 assembled with the seat 102 at a rear thereof, and left and right armrests 106 disposed at the left and right sides of the seat 102. The seat 102 can provide support for a user (not shown in FIG. 1) in a sitting position. The backrest 104 can be pivotally connected with the seat 102, and can be adjustable to recline with respect to the seat 102. The backrest 104 can include a back massaging module 108 disposed in an interior of the backrest 104. The back massaging module 108 may be operable to apply kneading and/or tapping massages along the backrest 104 from an upper portion of the backrest 104 to about a lower portion of the backrest 104 adjacent the seat 102. In other words, the back massaging module 108 may be operable to move along the back of the user from the shoulders to the waist and/or the buttocks of the user. The massage chair 100 can further include a foot massage unit 112 disposed on a floor below the seat 102. The foot massage unit 112 is operable to apply massage to foot portions of the user.

Figure 2:
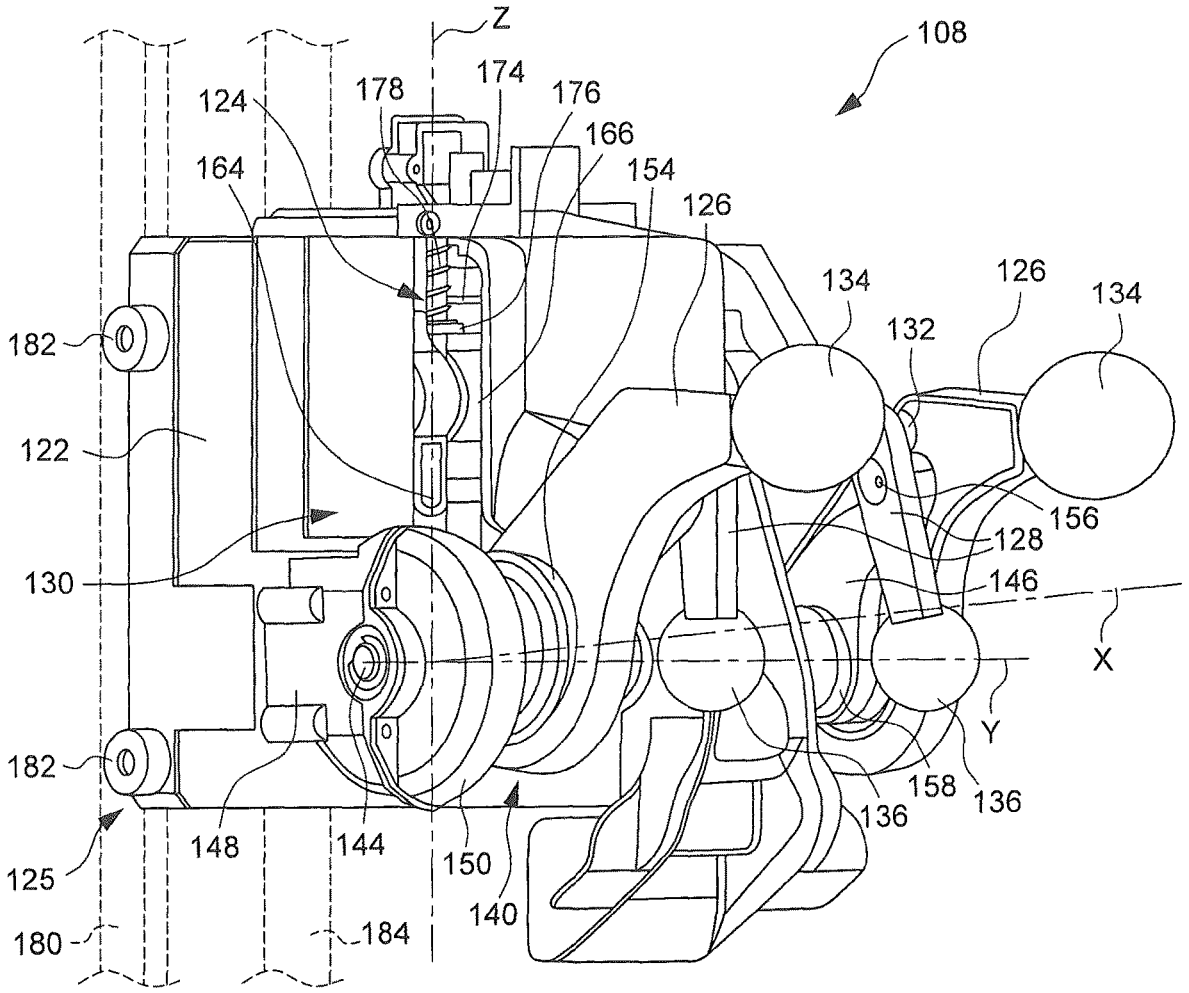
FIG. 2 is a schematic views illustrating the construction of a back massaging module provided in a backrest of the massage chair.
Figure 3:
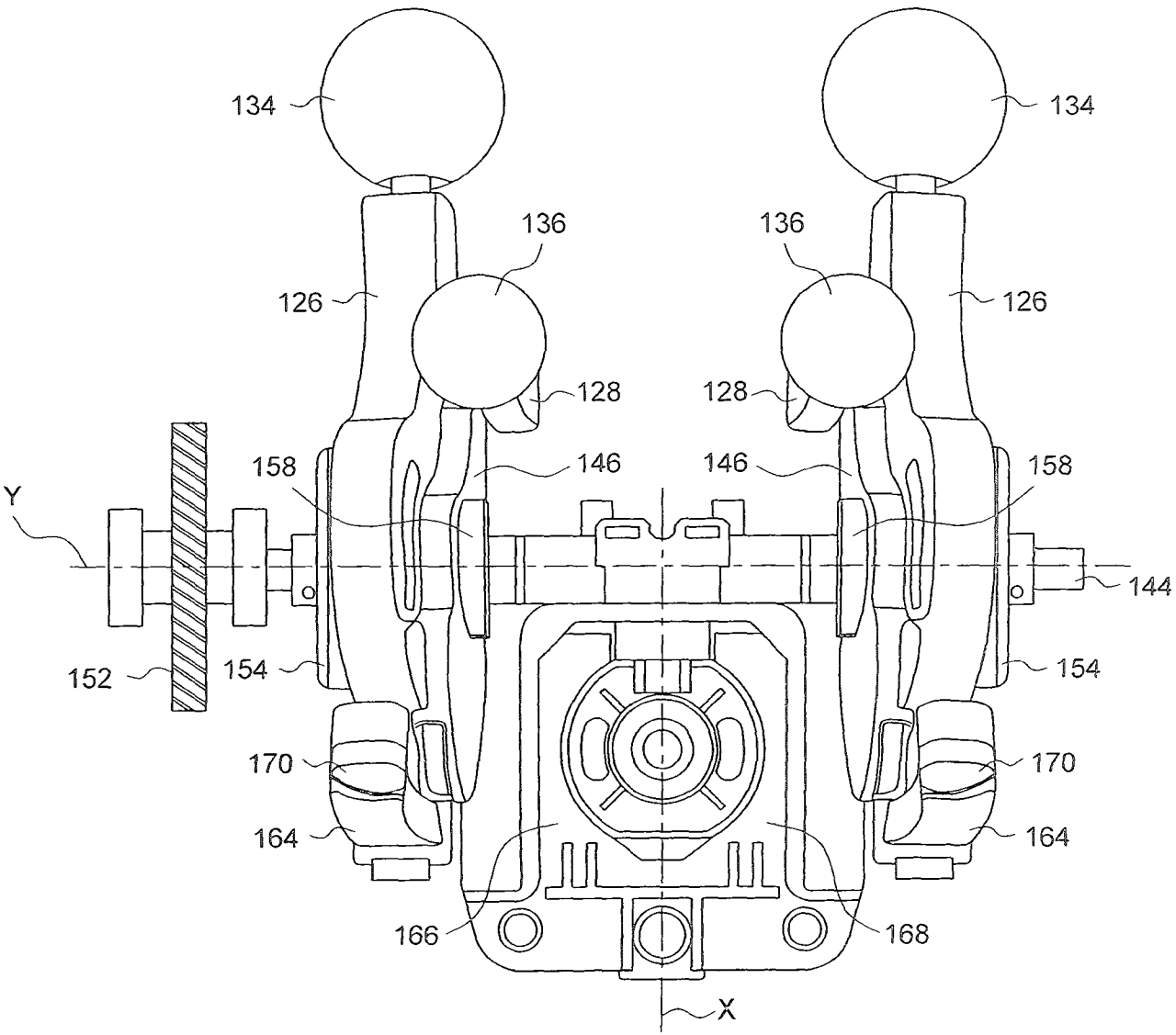
FIG. 3 is a bottom view of the back massaging module shown in FIG. 2.
Figure 4:
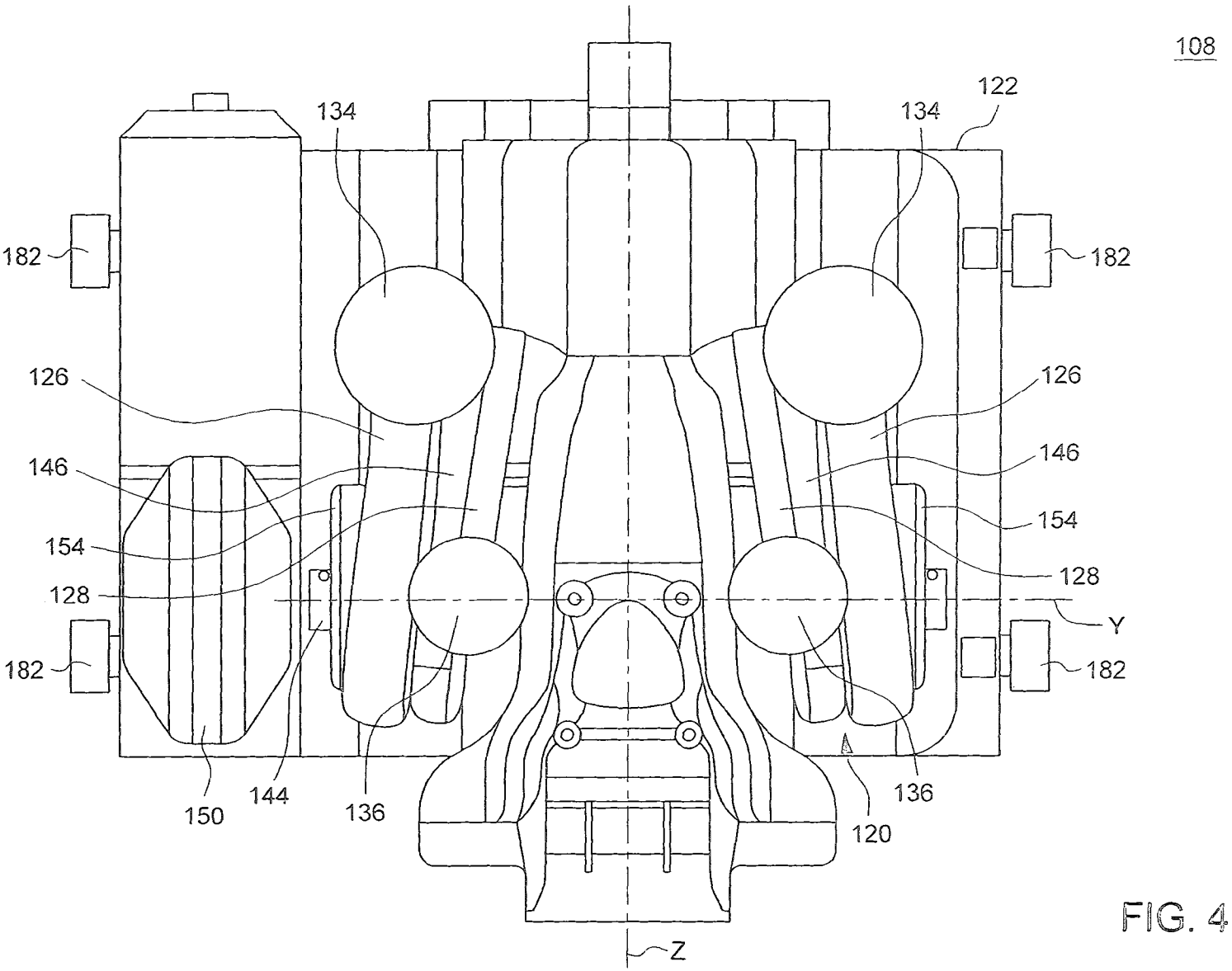
FIG. 4 is a front view of the back massaging module shown in FIG. 2.
Figure 5:
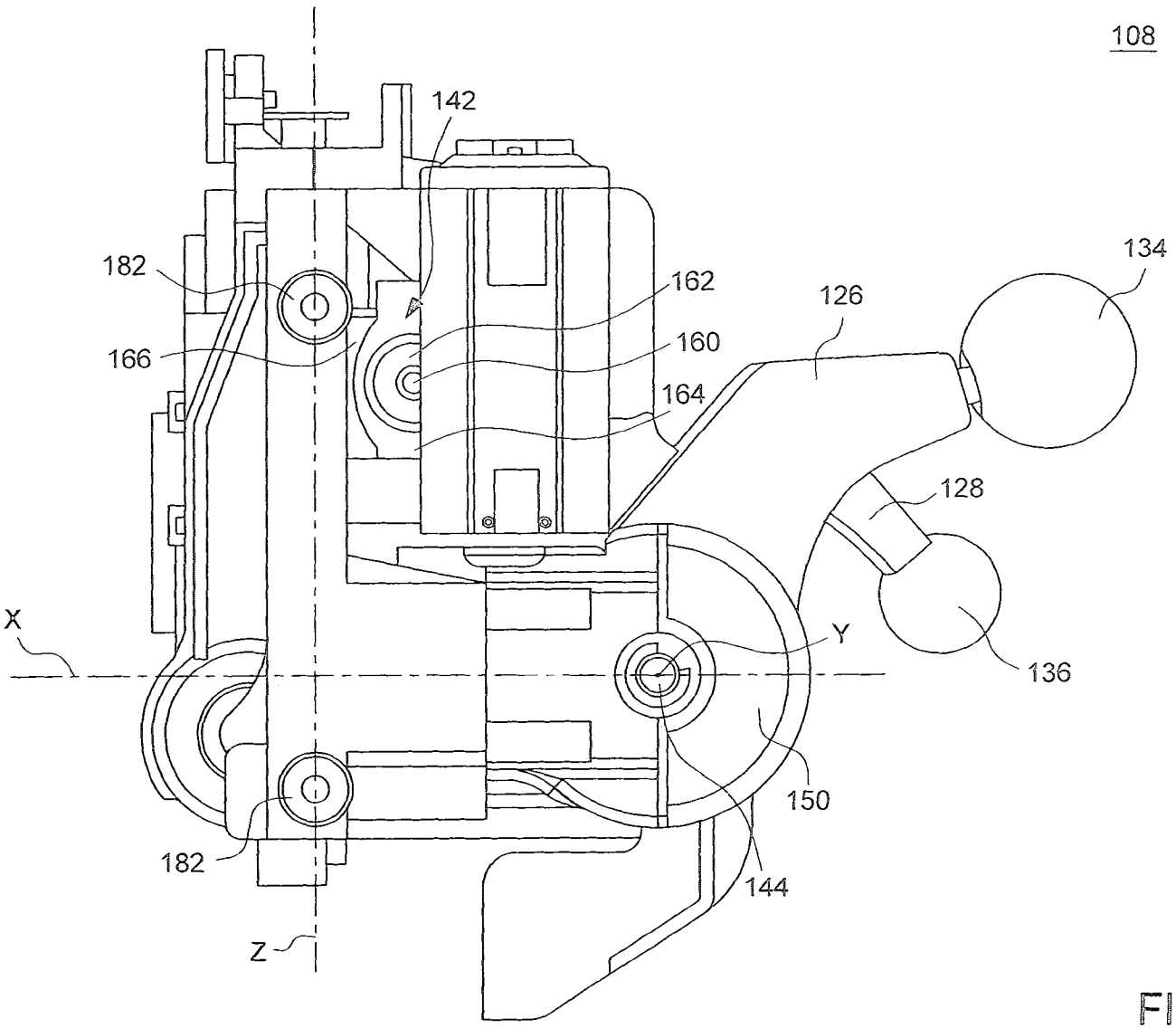
FIG. 5 is a side view of the back massaging module shown in FIG. 2.
Figure 6:
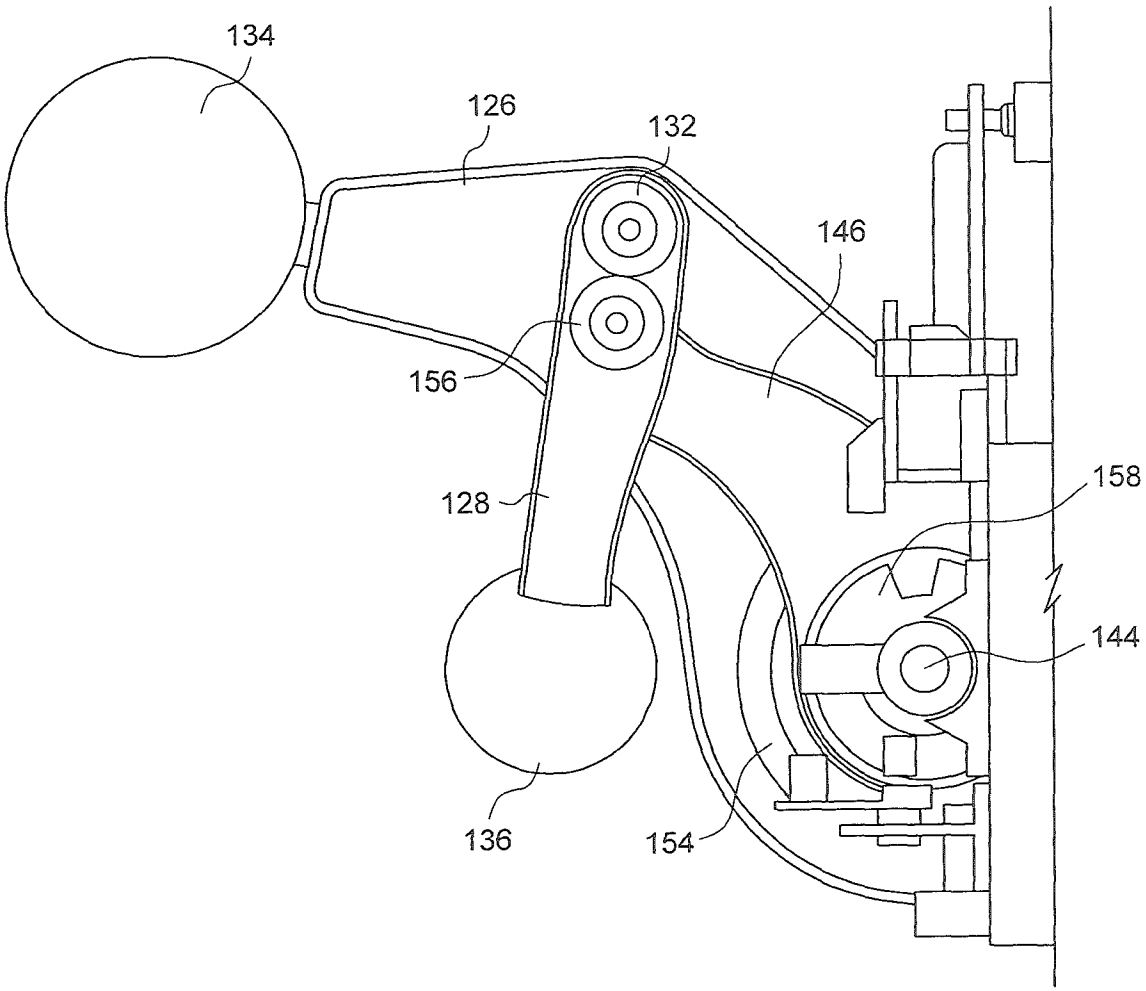
FIG. 6 is a schematic view illustrating the connection of massage arms and implemented in the back massaging module shown in FIG. 2.

In conjunction with FIG. 1, FIG. 2 is a perspective view illustrating the construction of the back massaging module 108, FIG. 3 is a bottom view of the back massaging module 108, FIG. 4 is a front view of the back massaging module 108, FIG. 5 is a side view of the back massaging module 108, and FIG. 6 is a schematic view illustrating the connection of massage arms 126 and 128 implemented in the back massaging module 108. The back massaging module 108 can be movable vertically along a height direction of the backrest 104, which is also referred herein as being parallel to a lengthwise axis Z. Referring to FIG. 2, the back massaging module 108 can include a massage mechanism 120, a platform 122 for supporting the massage mechanism 120, and a forward positioning mechanism 124. The platform 122 can be operatively connected with a vertical driving unit 125 operable to move the platform 122 and the massage mechanism 120 along the lengthwise axis Z. The forward positioning mechanism 124 can be operable to modify an amount of displacement of an upper end of the massage mechanism 120 along a front-rear axis X extending from a rear to a front of the backrest 104. The massage mechanism 120 can be operable to apply different types of massage actions on the user's body, such as pressure actions, kneading actions, tapping actions, and up and down rolling actions.

The massage mechanism 120 can include two sets of massage arms 126 and 128, and a driving unit 130 (shown in FIG. 2) operable to drive motion of the two sets of the massage arms 126 and 128. The two sets of the massage arms 126 and 128 may be symmetrical about the lengthwise axis Z. The two sets of the massage arms 126 and 128 can be transversally spaced apart from each other, and can rotate about a transversal axis Y extending horizontally from a left to a right side of the backrest 104. The two sets of massage arms 126 and 128 can have a similar construction, each of which includes two massage arms 126 and 128 that are pivotally assembled with or connected to each other about a pivot connection 132. The two massage arms 126 and 128 may be separated from each other and separately operable. The massage arm 126 can have a distal massage end. The massage arm 126 may be affixed with a contact member 134 (also referred hereinafter as "upper contact member 134"), and the other massage arm 128 can have a distal massage end. The massage arm 128 may be affixed with another contact member 136 (also referred hereinafter as "lower contact member 136"). Each of the contact members 134 and 136 can be formed as a roller, ball or pad made of a resin or hard rubber material. The pivot connection 132 can define a pivot axis extending transversally relative to the backrest 104 and substantially parallel to the transversal axis Y, and the massage arms 126 and 128 can be rotatable about the transversal axis Y.

The driving unit 130 can include a kneading drive mechanism 140 and a tapping drive mechanism 142 (as shown in FIG. 5). The kneading drive mechanism 140 can drive motion of the massage arms 126 and 128 so as to cause the contact members 134 and 136 to apply a kneading action. The kneading action can include a combination of pressing and stretching actions applied on a region of the user's body. The tapping drive mechanism 142 can drive motion of the massage arms 126 and 128 so as to cause the contact members 134 and/or 136 of each of the two sets of massage arms 126 and 128 to apply tapping massage on a desired region of the user's body.

Referring to FIGS. 2-6, the kneading drive mechanism 140 can include a rotary shaft 144 and two linkages 146. The rotary shaft 144 can be supported by a bearing 148 affixed to the platform 122, and can be driven in rotation by a kneading motor 150. For example, the rotary shaft 144 can be assembled with a gear 152 (better shown in FIG. 3), and the drive output of the kneading motor 150 can be transmitted via the gear 152 to drive rotation of the rotary shaft 144.

The rotary shaft 144 can be disposed through the two massage arms 126 and the two linkages 146. The rotary shaft 144 can be affixed with two cams 154 about which the two massage arms 126 are respectively assembled with the rotary shaft 144. The cams 154 are such that when the rotary shaft 144 is driven in rotation by the kneading motor 150, the two massage arms 126 can respectively swing and wobble or oscillate about the transversal axis Y extending along the rotary shaft 144, which results in a periodic swing motion of the upper contact members 134. In one embodiment, the two cams 154 can be configured to create a phase difference of 180° between the two massage arms 126. When the rotary shaft 144 rotates, the upper contact members 134 of the massage arms 126 can thereby swing toward and away from each other in an alternated manner.

The two linkages 146 are respectively connected with the two massage arms 128 and the rotary shaft 144. More specifically, each linkage 146 can have a first end portion connected with one corresponding massage arm 128 about a pivot connection 156 (better shown in FIG. 6). The pivot connection 156 is arranged on the massage arm 128 at a location between the contact member 136 and the pivot connection 132, and can define a pivot axis that transversally extends parallel to the transversal axis Y. Moreover, each linkage 146 can further have a second end portion that is connected to a corresponding cam 158 affixed with the rotary shaft 144. When the rotary shaft 144 rotates, the two linkages 146 connected with the two cams 158 can respectively swing and wobble or oscillate about the transversal axis Y like the massage arms 126.

The two cams 158 can create a phase difference of 180° between the two linkages 146 such that when the rotary shaft 144 rotates, the two linkages 146 can swing toward and away from each other in an alternated manner. Moreover, the cams 154 and 158 are further configured to create a differential rotation between the massage arm 126 and the linkage 146 connected thereto about the transversal axis Y. When the rotary shaft 144 rotates, the linkage 146 can accordingly drive the corresponding massage arm 128 to rotate about the pivot connection 156 to have the lower contact member 136 of the massage arm 128 to move alternately toward and away from the upper contact member 134 of the massage arm 126.

With the aforementioned construction, rotation of the rotary shaft 144 can drive the upper contact members 134 of the massage arms 126 and the lower contact members 136 of the massage arms 128 to alternately swing toward and away from each other in an alternated manner, the upper contact members 134 and the lower contact members 136 moving in phase toward and away from each other. In the meantime, the lower contact members 136 of the massage arms 128 can also respectively move alternately toward and away from the upper contact members 134 of the massage arms 126 along the lengthwise axis Z. The aforementioned motion can produce effective kneading massage actions on a desired region of the user's body.

Referring to FIGS. 2, 3 and 5, the tapping drive mechanism 142 can include a rotary shaft 160, two spaced-apart cams 162, two crankshafts 164, a frame 166 and a tapping motor 168 (better shown in FIG. 3). The rotary shaft 160 extends transversally and parallel to the rotary shaft 144, and can be supported by the frame 166 mounted for up and down movements along the lengthwise axis Z relative to the platform 122. The two cams 162 are affixed with the rotary shaft 160 with a 180° phase difference. Each of the two crankshafts 164 can have a first end portion connected with one corresponding cam 162, and a second end portion connected with one corresponding massage arm 126 via a spherical joint 170. The tapping motor 168 can be coupled integrally with the frame 166, and the tapping motor 168, the rotary shaft 160 and the frame 166 can move in unison along the lengthwise axis Z relative to the platform 122.

Rotation of the rotary shaft 160 and the cams 162 driven by the tapping motor 168 can cause reciprocated vertical displacement of the crankshafts 164, which in turn drive the massage arms 126 to respectively pivot about the rotary shaft 144 and the upper contact members 134 to move along the front-rear axis X. More specifically, the motion of the left and right massage arms 126 can occur in alternate manner owing to the 180° phase difference between the two cams 162 (e.g., the upper contact member 134 of the left massage arm 126 moves forward while the upper contact member 134 of the right massage arm 126 moves rearward, and vice versa). This operation can produce a tapping action on the user's body.

Figure 7:
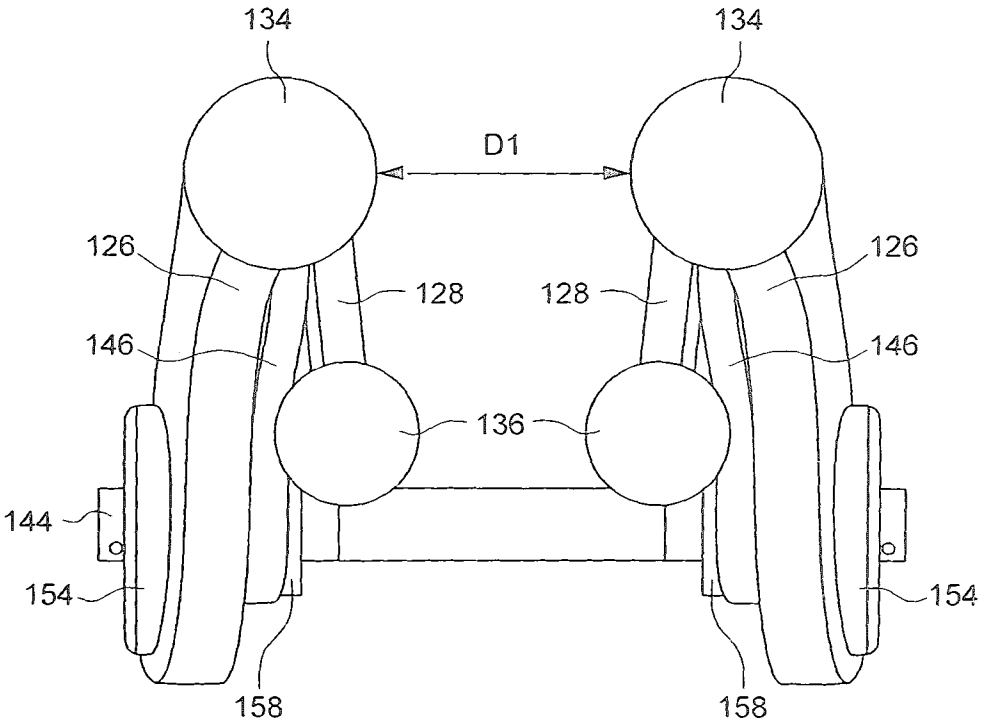
FIG. 7 is a schematic view illustrating the massage arms of the back massaging module in a narrow state.
Figure 8:
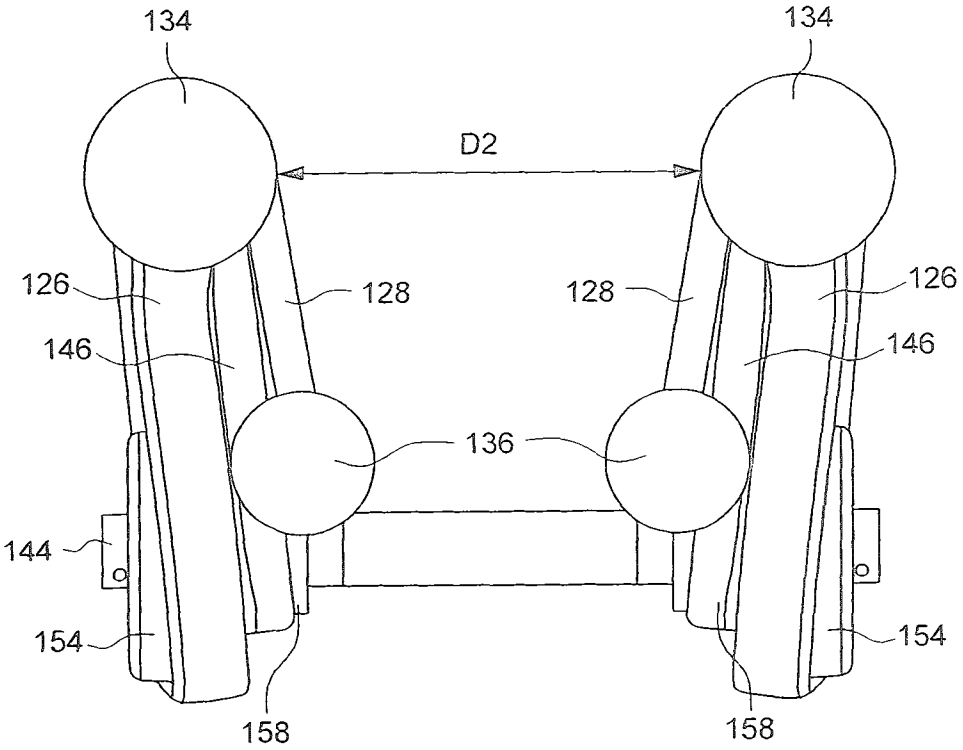
FIG. 8 is a schematic view illustrating the massage arms of the back massaging module in a wide state.

The output of the kneading motor 150 can further be controlled so as to position the upper contact members 134 of the massage arms 126 relatively closer or farther from each other along the transversal axis Y. FIGS. 7 and 8 are schematic views illustrating two exemplary states of the massage arms 126 that can be reached by controlling the revolution of the kneading motor 150. The massage arms 126 can be controllably placed in different configurations corresponding to different distances between the upper contact members 134 along the transversal axis Y.

In FIG. 7, D1 designates a smallest distance between the upper contact members 134, which corresponds to a "narrow state" of the upper contact members 134. In FIG. 8, D2 designates a greatest distance between the upper contact members 134 that is larger than D1, which corresponds to a "wide state" of the upper contact members 134.

The kneading drive mechanism 140 can actuate the massage arms 126 and 128 to perform kneading displacements between the narrow state and the wide state. In addition, the kneading drive mechanism 140 can actuate the massage arms 126 and 128 to perform kneading displacements to any positions between the narrow state and the wide state.

Referring again to FIGS. 2-6, the forward positioning mechanism 124 can be operable to cause the massage arms 126 and 128 to rotate about the rotary shaft 144 so as to modify a forward displacement of the contact members 134 and 136 along the front-rear axis X. While the massage arms 126 and 128 are placed at a given position along the lengthwise axis Z, the forward positioning mechanism 124 can drive a displacement of the massage arms 126 and 128 to cause the contact members 134 and 136 to apply or remove a pressure on the body. In one embodiment, the forward positioning mechanism 124 can include a guide body 174 located between the two massage arms 126, a slider 176 disposed inside the guide body 174, and a feed screw 178 coupled with an electric motor (not shown).

The guide body 174 can be affixed with the frame 166, and can have the shape of a box that has a slot along which the slider 176 can be guided for vertical movement along the lengthwise axis Z. The slider 176 can have a vertical threaded hole through which the feed screw 178 can be engaged. The feed screw 178 can be operatively connected with an electric motor (not shown). A rotation of the feed screw 178 driven by the electric motor can thereby cause up and down movements of the slider 176 in the guide body 174.

When the feed screw 178 rotates in a first direction, the slider 176 can move upward until it abuts against an upper edge of the guide body 174. Once the slider 176 engages with the upper edge of the guide body 174, further rotation of the feed screw 178 in the first direction causes the slider 176 to push the guide body 174, the frame 166 and the tapping motor 168 upward. The upward displacement of the frame 166 and the tapping motor 168 can be transmitted through the crankshafts 164 to the massage arms 126, which cause the massage arms 126 to rotate about the rotary shaft 144 in a direction for concurrently moving the upper contact members 134 forward and retracting the lower contact members 136 backward. This displacement may allow the upper contact members 134 and/or lower contact members 136 to apply pressure on desired regions of the body.

When the feed screw 178 rotates in a second direction opposite to the first direction, the slider 176 can move downward until it abuts against a lower edge (not shown) of the guide body 174. Once the slider 176 engages with the lower edge of the guide body 174, further rotation of the feed screw 178 in the second direction causes the slider 176 to push the guide body 174, the frame 166 and the tapping motor 168 downward. The downward displacement of the frame 166 and the tapping motor 168 can be transmitted through the crankshafts 164 to the massage arms 126, which cause the massage arms 126 to rotate about the rotary shaft 144 in another direction for concurrently moving the lower contact members 136 forward and retracting the upper contact members 134 backward.

Referring again to FIGS. 2-6, the vertical driving unit 125 can be operable to move the massage arms 126 and 128 along the lengthwise axis Z. The vertical driving unit 125 can include a pair of rails 180 (shown with phantom lines in FIG. 2), guide rollers 182 and a screw shaft 184 (also shown with phantom lines in FIG. 2). The rails 180 can be affixed inside the backrest 104, and extend along the lengthwise axis Z. The guide rollers 182 can be assembled with the left and right sides of the platform 122, and can be guided for movement along the rails 180. The screw shaft 184 can engage with a built-in nut (not shown) provided in the platform 122, and can be driven in rotation by an electric motor (not shown). When the screw shaft 184 is driven in rotation, the platform 122 and the massage dispensing mechanism 120 can move up and down in unison along the lengthwise axis Z.

Figure 9:
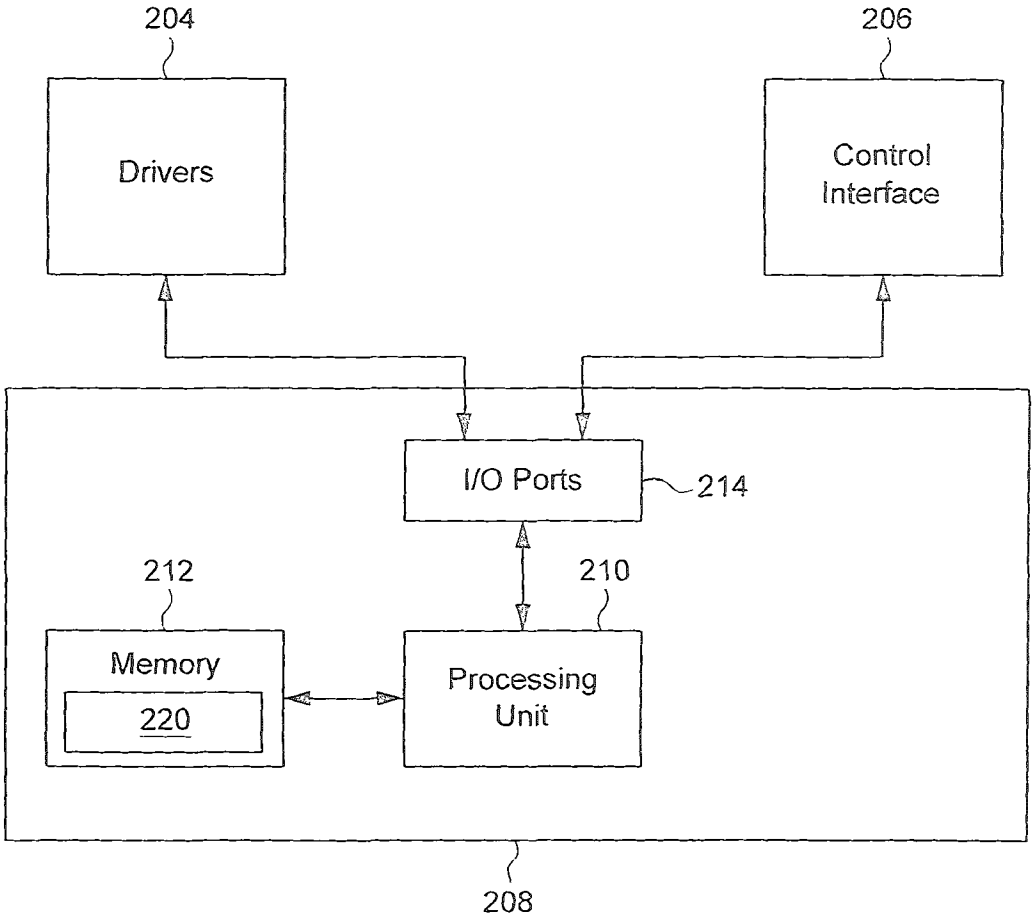
FIG. 9 is a simplified block diagram illustrating one embodiment of a control system implemented in the massage apparatus.
Figure 10:
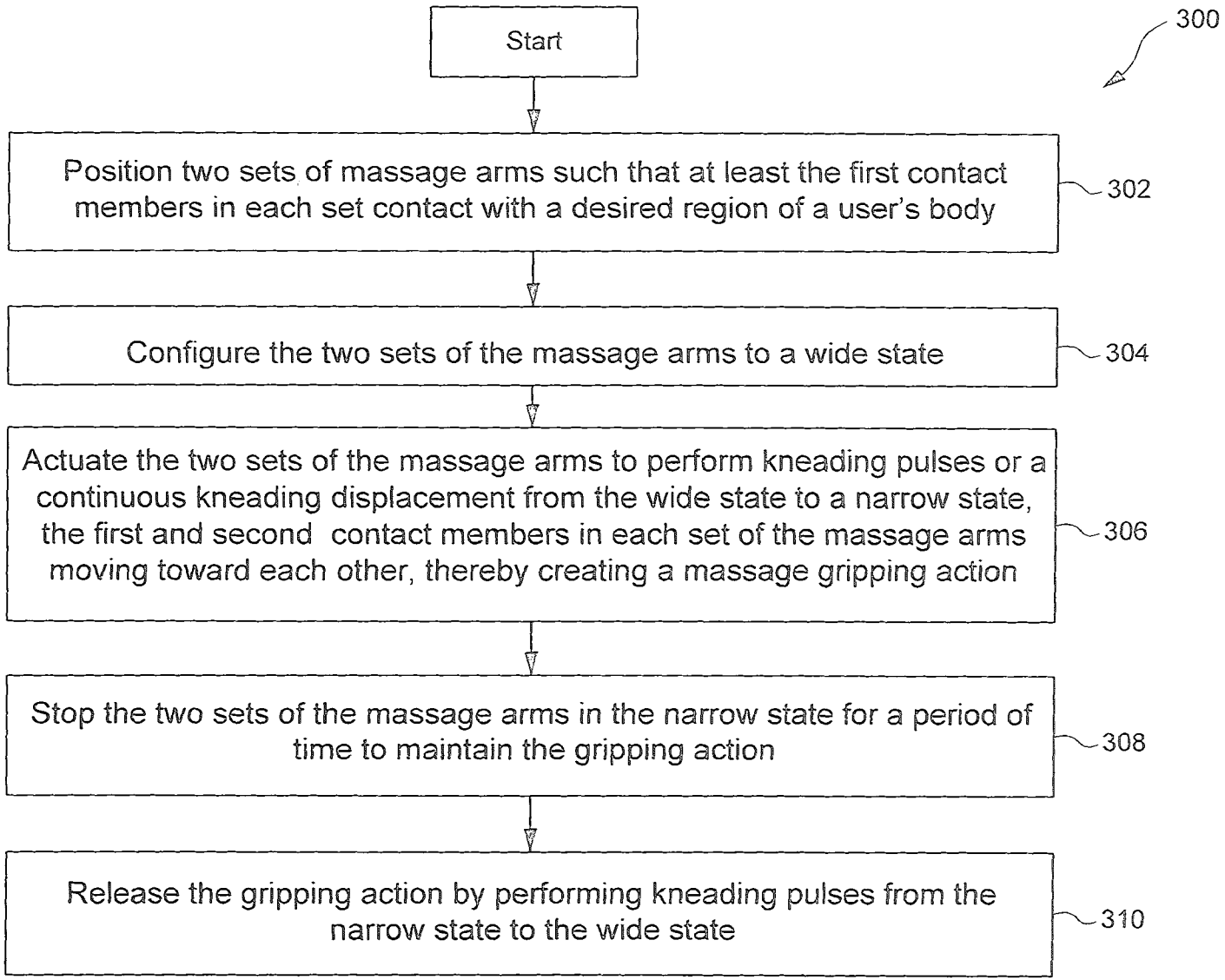
FIG. 10 is a flowchart illustrating method steps of a sequence of massage actions implemented in the massage apparatus.

FIG. 9 is a simplified block diagram illustrating one embodiment of a control system 202 implemented in the massage apparatus 100. The control system 202 can include a plurality of drivers 204, a control interface 206 and a microcontroller 208. The drivers 204 can be electric circuits operable to drive operation of various components of the massage apparatus 100 according to control signals outputted by the microcontroller 208. Examples of components driven by the drivers 204 can include the respective motors of the kneading drive mechanism 140, the tapping drive mechanism 142, the forward positioning mechanism 124 and the vertical driving unit 125, airbag pumps (not shown), solenoids, etc.

The control interface 206 can be connected with sensors and limit switches arranged in the massage apparatus 100, and can deliver various detection signals to the microcontroller 208 to provide information such as physical height of the user, limits of movements, motor revolutions, etc.

The microcontroller 208 can control and supervise the operation of the massage apparatus 100. In one embodiment, the microcontroller 208 can exemplary be a 32-bit Reduced Instruction Set Computing (RISC) microcontroller. The microcontroller 208 can select one of a plurality of massage programs stored internally, and execute the selected massage program through the drivers 204. In one embodiment, the microcontroller 208 can exemplary include a processing unit 210, a memory 212 for storing massage program codes, and input/output (I/O) ports 214 through which the processing unit 210 can exchange signals with the drivers 204 and the control interface 206.

The memory 212 can store the codes of multiple massage programs 220 available in the massage apparatus 100. Each of the massage programs 220 can be executable by the processing unit 210 of the microcontroller 208 so as to actuate the massage arms 126 and 128 to perform a sequence of predetermined massage actions on a user's body. All the displacements of the massage arms 126 and 128 can be conducted in a spatial coordinate system defined by the lengthwise axis Z, the transversal axis Y and the front-rear axis X.

Figure 11A:
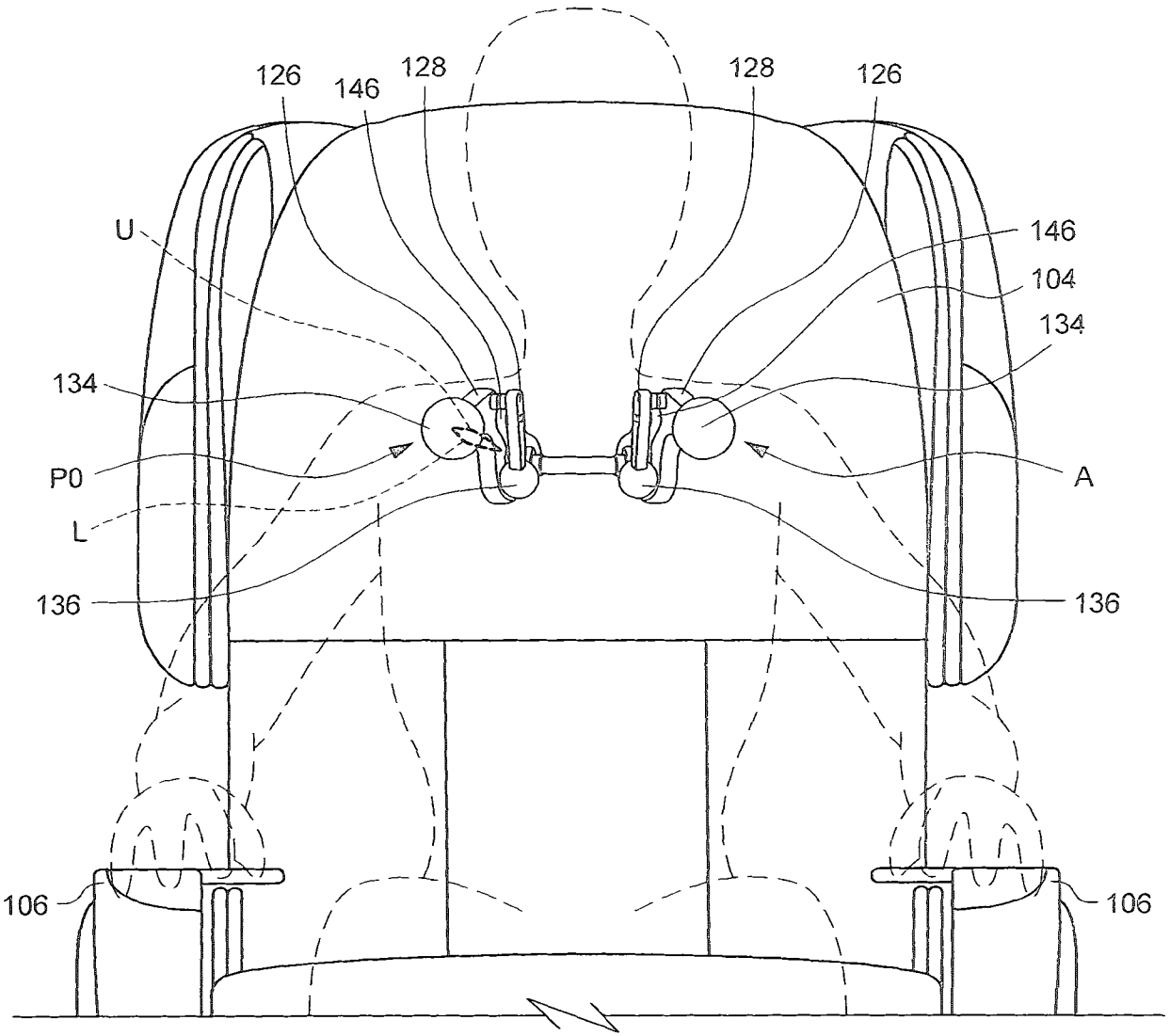
FIGS. 11A-11F are schematic views illustrating certain intermediate positions occupied by the massage arms in the sequence of massage actions described in FIG. 10.
Figure 11B:
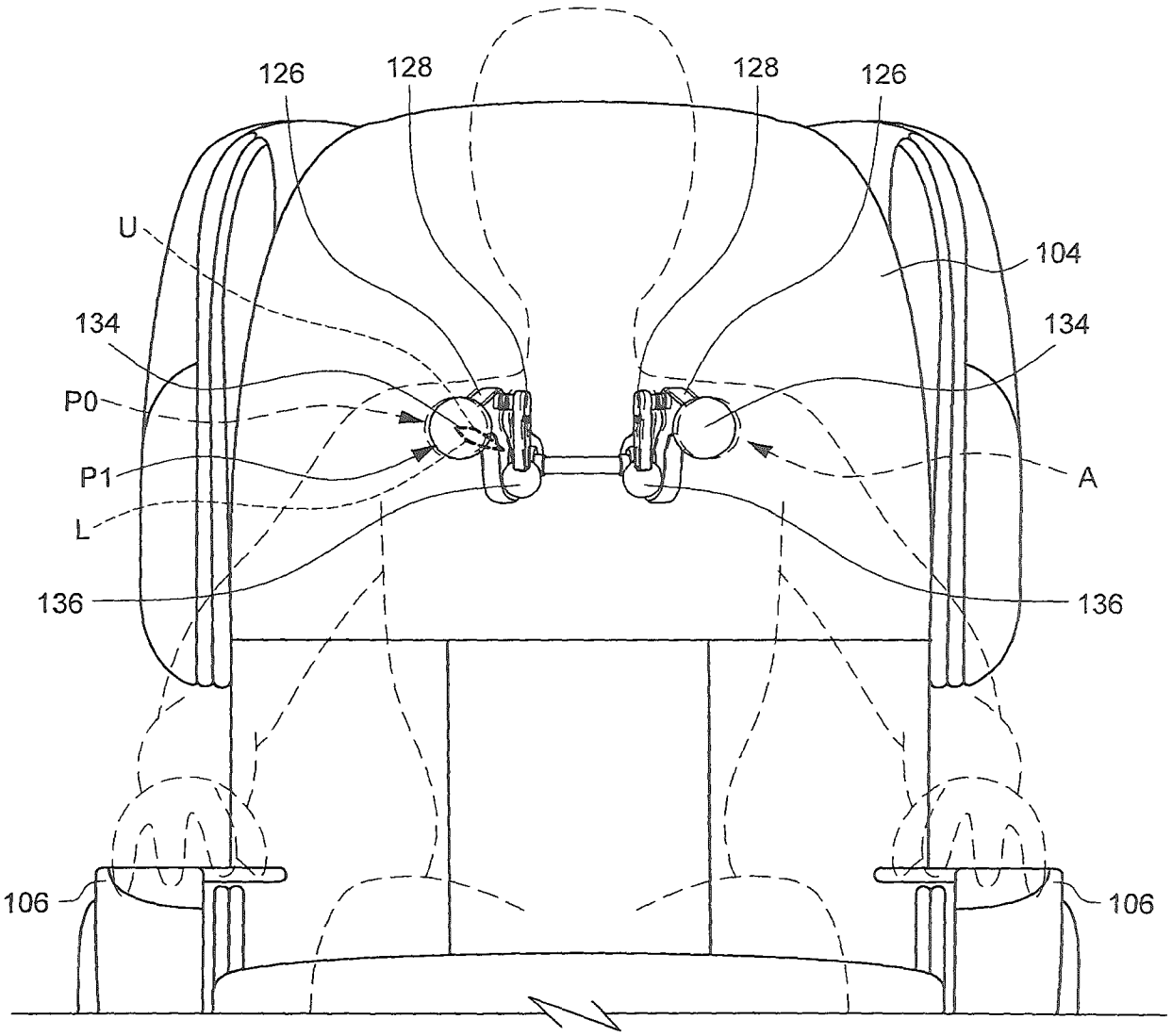
Figure 11C:
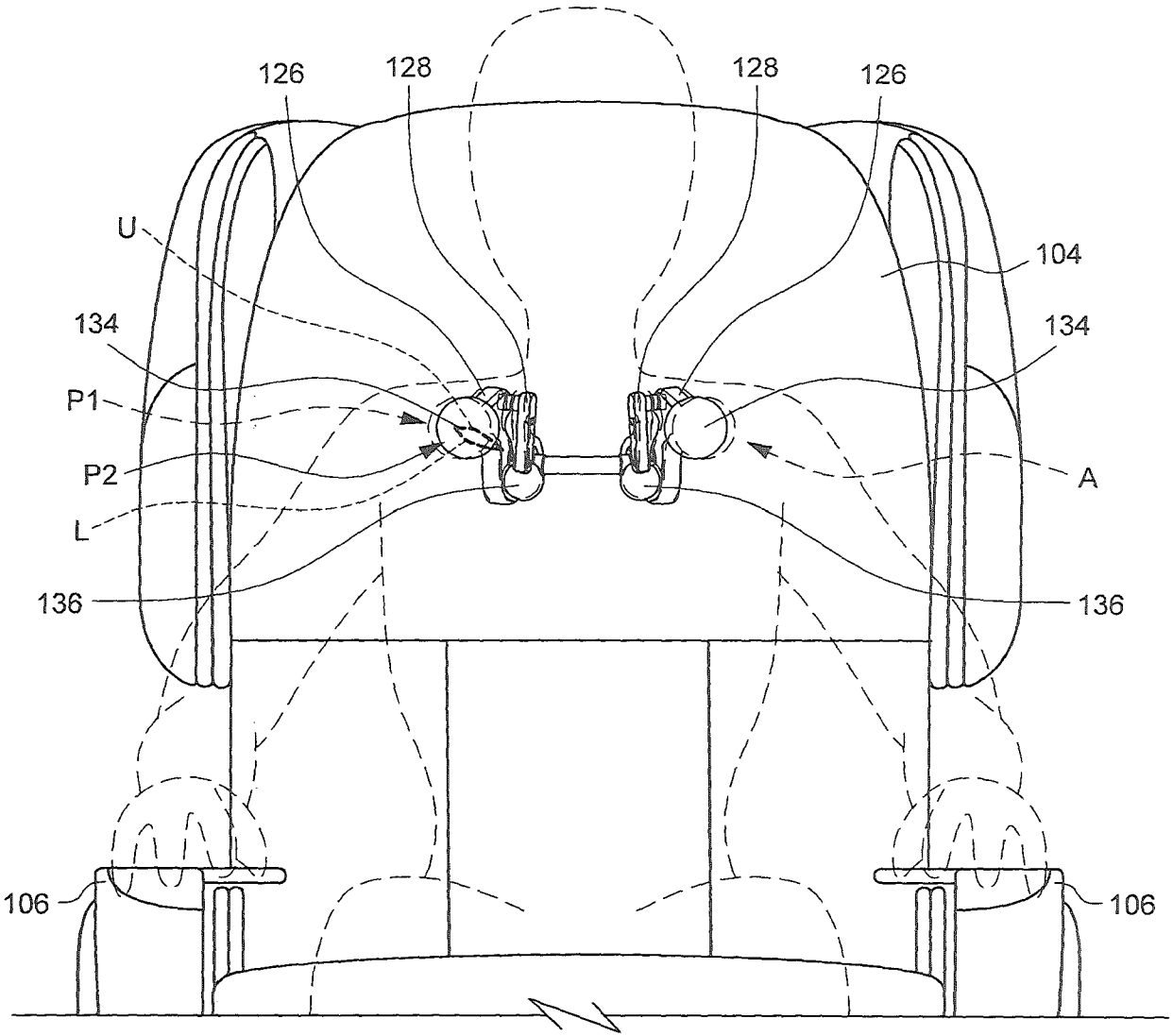
Figure 11D:
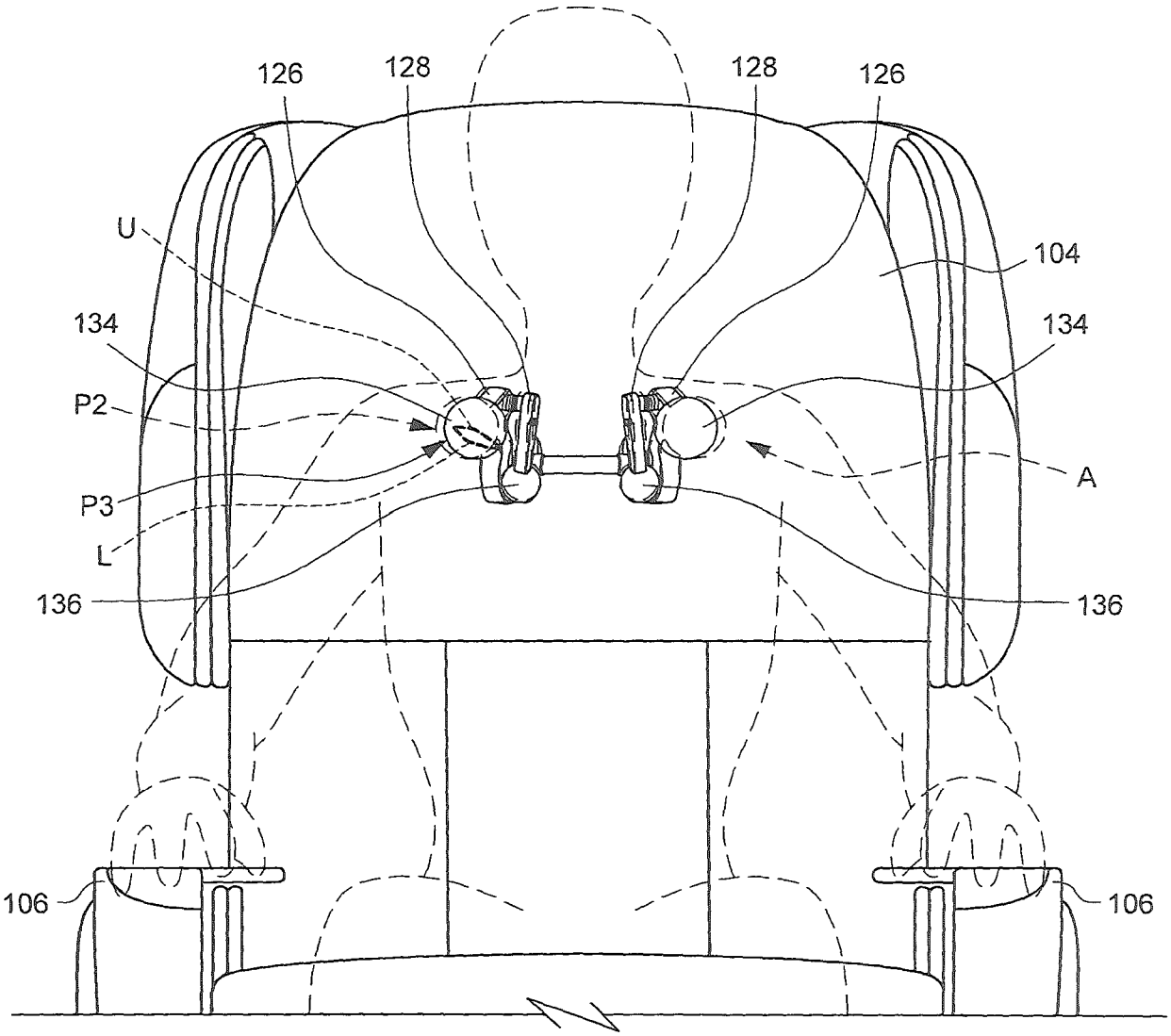
Figure 11E:
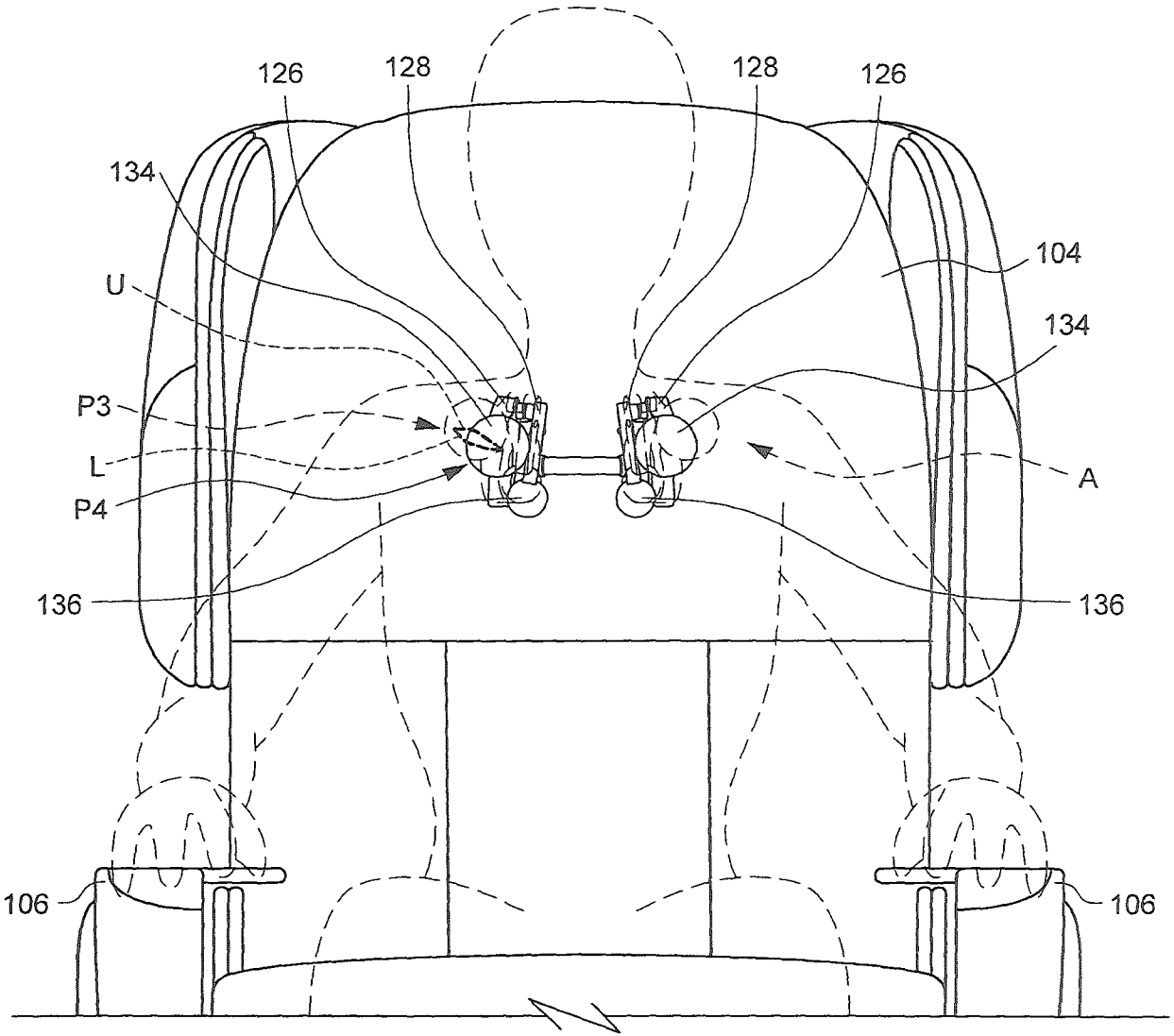

In conjunction with FIGS. 1-9, FIG. 10 is a flowchart of a sequence of massage actions 300 implemented in the massage apparatus 100, and FIGS. 11A-11F are schematic views illustrating certain intermediate positions occupied by the massage arms 126 and 128 during the sequence of massage actions 300. In initial step 302, the massage arms 126 and 128 can be positioned such that at least the upper contact members 134 of the massage arms 126 contact a desired region of a user's body. The massage arms 126 and 128 can be displaced to the desired position along the lengthwise axis Z by the vertical driving unit 125, and the forward positioning mechanism 124 can drive a forward displacement of the massage arms 126 as described previously so that the upper contact member 134 can suitably press against the user's body. In one embodiment, the sequence of massage actions 300 can be applied to release tension and pain at an upper shoulder area A, and the massage arms 126 and 128 can be placed at a position P0 so that the upper contact members 134 of the massage arms 126 press against the upper shoulder area A as shown in FIG. 11A.

In next step 304, the kneading drive mechanism 140 can actuate the two sets of the massage arms 126 and 128 to place the upper contact members 134 in the wide state as shown in FIG. 8. The wide state can be set by controllably rotating the rotary shaft 144. While they are at the initial position P0, the massage arms 126 and 128 thus are also configured in the wide state.

In next step 306, while the massage arms 126 and 128 are in the wide state, the kneading drive mechanism 140 then can actuate the massage arms 126 and 128 to perform a sequence of kneading pulses or a continuous kneading displacement from the wide state to the narrow state.

Figure 11F:
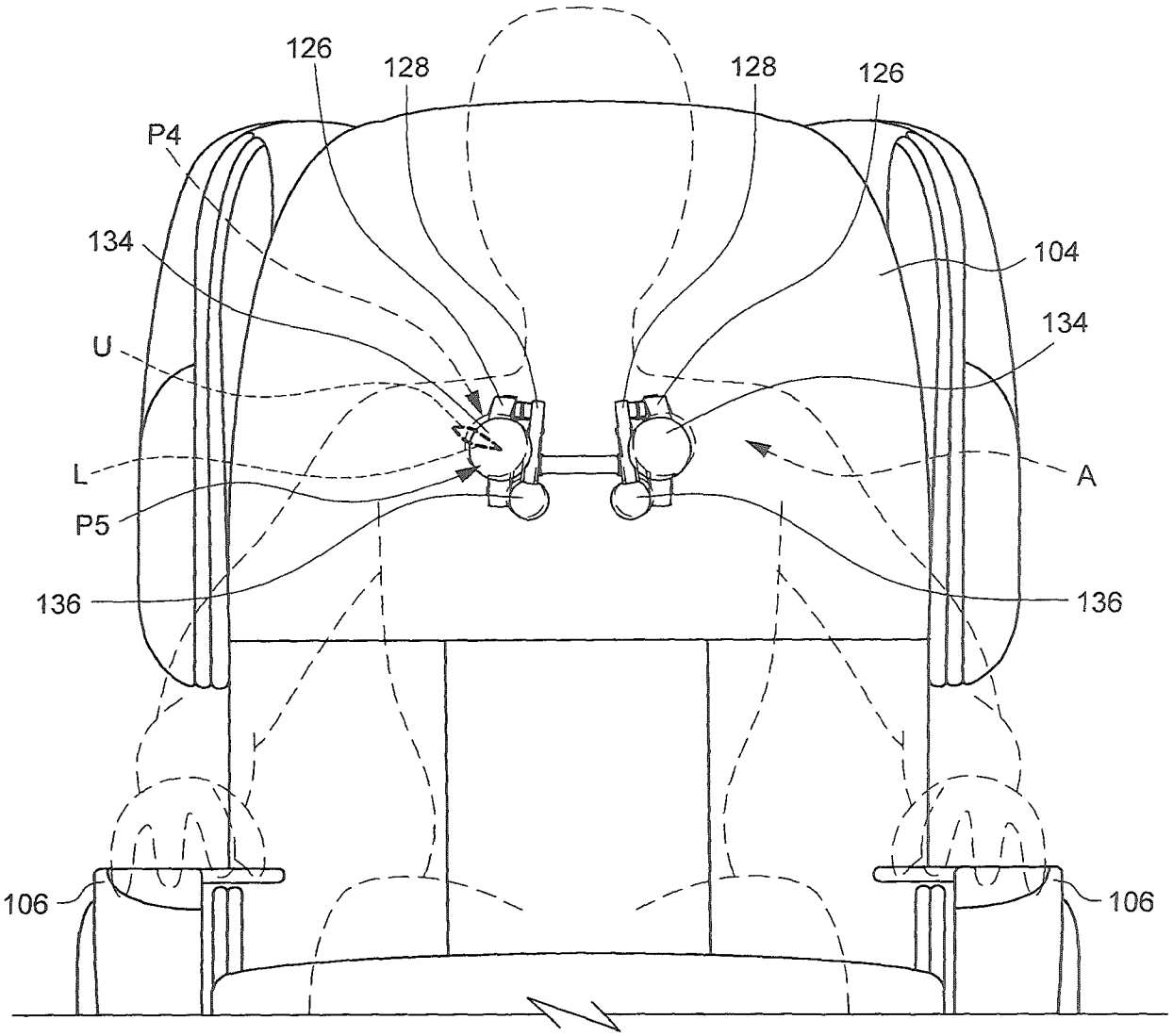

In case kneading pulses are applied in step 306, each kneading pulse can be accomplished by a limited rotational movement of the rotary shaft 144, which can result in a limited kneading displacement of the two massage arms 126 and 128. Moreover, the contact members 134 and 136 in each set of the massage arms 126 and 128 can gradually move toward each other at each kneading pulse. FIGS. 11B-11F are schematic views illustrating the progression of the massage arms 126 and 128 after each kneading pulse from the wide state (as shown in FIG. 11A) to the narrow state (as shown in FIG. 11F), the solid lines showing the successive positions P1, P2, P3, P4 and P5 occupied by the massage arms 126 and 128 after each kneading pulse, and the phantom lines showing a previous position immediately before each kneading pulse.

Each of the kneading pulses as described above has a pulse duration, and two successive kneading pulses are timely separated by a hold interval during which the massage arms 126 and 128 remain stationary, the pulse duration being shorter than the hold interval. In one embodiment, the pulse duration may be constant throughout the sequence of the kneading pulses. Moreover, each kneading pulse can have a pulse duration less than 1 second. For example, the pulse duration can be about 0.2 seconds, and the hold interval can be about 0.4 seconds. These time intervals may vary, e.g., the pulse duration and the hold interval may be longer, such as 0.3 seconds and 0.5 seconds, 0.4 seconds and 0.6 seconds, etc. The massage arms 126 and 128 can perform the aforementioned kneading pulses until the narrow state (e.g., as shown in FIG. 7) is reached. In one embodiment, the massage arms 126 and 128 may exemplary perform two to five pulses from the wide state to the narrow state.

In case a continuous kneading action is applied in step 306, the rotary shaft 144 may continuously rotate to cause a continuous kneading displacement of the massage arms 126 and 128 from the wide state to the narrow state (i.e., without stop between the wide and narrow state). Like previously described, the contact members 134 and 136 in each set of the massage arms 126 and 128 can move toward each other during this continuous kneading displacement so that a massage gripping action can be applied on the user' body along both the transversal axis Y and the lengthwise axis Z.

The aforementioned pulse or continuous kneading movement from the wide state to the narrow state can result in a massage gripping or pinching action that is applied on the user' body along both the transversal axis Y and the lengthwise axis Z. A maximum gripping effect can be provided when the two sets of the massage arms 126 and 128 reach the narrow state.

As shown in FIGS. 11A-11F, it is worth noting that each upper contact member 134 can respectively move between the wide and narrow state along a closed path or loop (shown with phantom lines) that has an upper path portion U and a lower path portion L (only the moving path of one contact member 134 is shown for clarity, the moving path of the other contact member 134 being symmetrical). The shown movement path may be, e.g., that of the center of the upper contact member 134. When the rotary shaft 144 rotates in a first direction from the wide state to the narrow state, the upper contact member 134 of each massage arm 126 can respectively move along the upper path portion U to apply the gripping action. When the rotary shaft 144 rotates in a second direction opposite to the first direction from the wide state to the narrow state, the upper contact member 134 of each massage arm 126 can respectively move along the lower path portion L to apply the gripping action.

In next step 308, once the narrow state is reached (e.g., corresponding to the position P5 shown in FIG. 11F), the two sets of the massage arms 126 and 128 are held stationary in the narrow state for a period of time to hold the gripping action. This hold period of time during which the two sets of the massage arms 126 and 128 are kept stationary may be a few seconds, e.g., 1, 2 or 3 seconds.

In next step 310, once the hold period of time elapses, the kneading drive mechanism 140 then can drive the massage arms 126 and 128 to move from the narrow state to the wide state for releasing the massage gripping action. This releasing displacement can result in the contact members 134 and 136 in each set of the massage arms 126 and 128 moving away from each other. In one embodiment, the massage arms 126 and 128 can perform a plurality of kneading pulses from the narrow state to the wide state to release the massage grip action. These kneading pulses can be imparted by rotational displacements of the rotary shaft 144 in either direction. For example, the rotary shaft 144 may rotate in a first direction to apply the kneading pulses in step 306, and in a second direction opposite to the first direction to release the massage grip action in step 310 (i.e., the upper contact member 134 moves along the same path portion (i.e., either of the upper and lower path portion U and L) from the wide to narrow state and reversely. Alternatively, the rotary shaft 144 may rotate in the same direction to apply the kneading pulses in step 306 and release the massage grip action in step 310 (i.e., each of the upper contact member 134 can move along one of the upper and lower path portion U and L from the wide to narrow state, and then along the other one of the upper and lower path portion U and L from the narrow to wide state). The kneading pulses for releasing the massage grip action may be similar or different from the kneading pulses performed in step 306, i.e., with similar or different pulse duration and/or hold interval.

The sequence of massage actions in steps 302 through 310 can be completed in a relatively short time, e.g., less than 60 seconds, or even less than 20 seconds.

Figure 12:
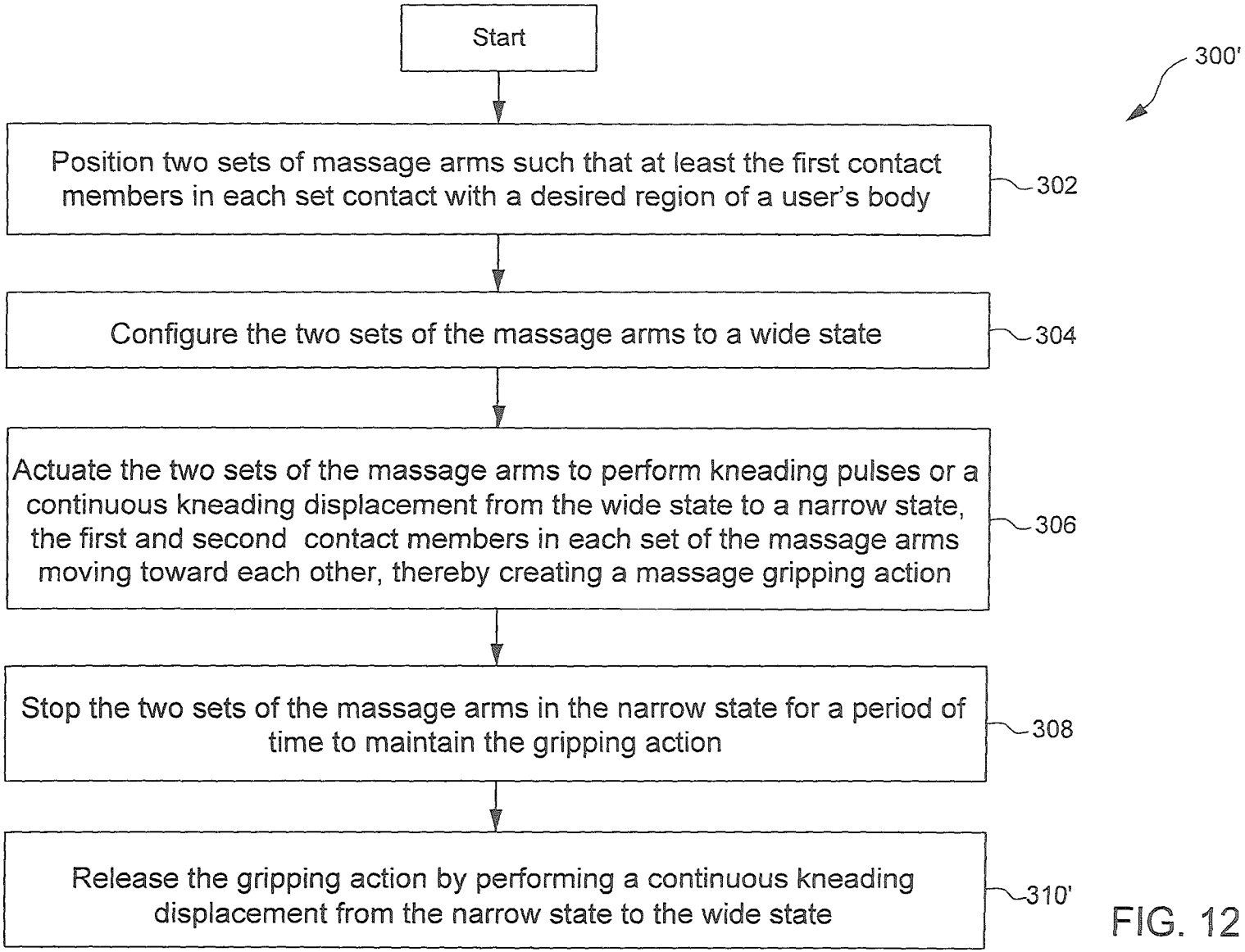
FIG. 12 is a flowchart illustrating a variant embodiment of a sequence of massage actions implemented in the massage apparatus.
Figure 13:
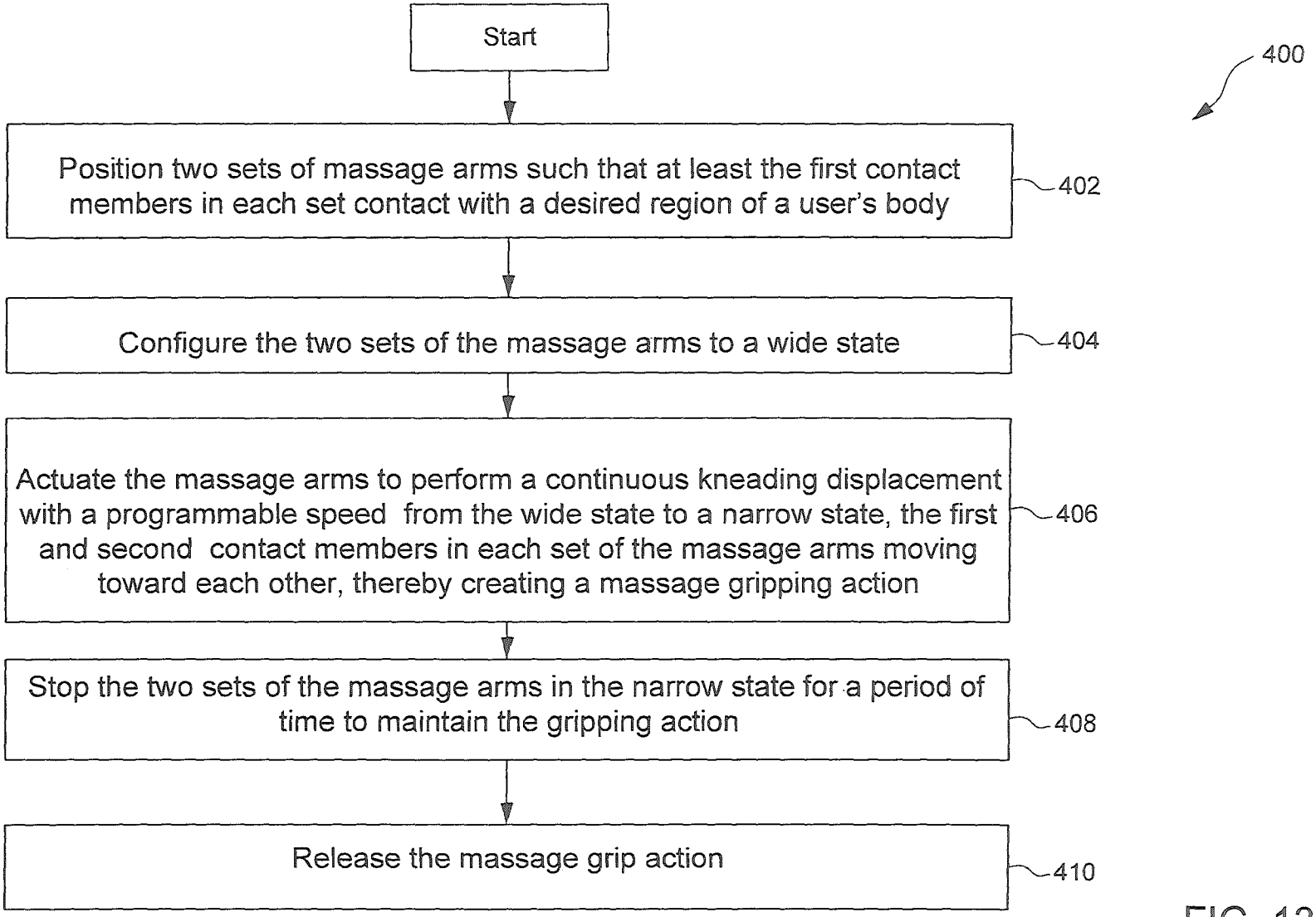
FIG. 13 is a flowchart of another sequence of massage actions implemented in the massage apparatus.

FIG. 12 is a flowchart illustrating a variant embodiment of a sequence of massage actions 300' implemented in the massage apparatus 100. The sequence of massage actions 300' is very similar to the massage actions 300, except that step 310' replaces the previous step 310. Rather than kneading pulses, the massage arms 126 and 128 in step 310' can perform a continuous kneading displacement from the narrow state to the wide state (i.e., without stop between the narrow and wide state) to release the massage gripping action. The continuous kneading displacement can be effected by a continuous rotational displacement of the rotary shaft 144 from the narrow state to the wide state. Like previously described, the contact members 134 and 136 in each set of the massage arms 126 and 128 can move away from each other for releasing the gripping action.

In conjunction with FIGS. 1-9, FIG. 13 is a flowchart of another sequence of massage actions 400 implemented in the massage apparatus 100 for applying a massage gripping action. In initial step 402, the massage arms 126 and 128 can be positioned such that at least the upper contact members 134 of the massage arms 126 contact a desired region of the user's body, e.g., the upper shoulder area.

In next step 404, the kneading drive mechanism 140 can actuate the two sets of the massage arms 126 and 128 to place the upper contact members 134 in the wide state as shown in FIG. 8. The massage arms 126 and 128 thus are placed in the wide state and in contact with the user's body.

In next step 406, while the massage arms 126 and 128 are in the wide state, the kneading drive mechanism 140 can actuate the massage arms 126 and 128 to perform a continuous kneading displacement from the wide state to the narrow state with a programmable speed. The rotational speed of the rotary shaft 144 may be selected among a range of low to high speed values to desirably set the speed at which the massage arms 126 and 128 move from the wide state toward the narrow state. Like previously described, the contact members 134 and 136 in each set of the massage arms 126 and 128 can continuously move toward each other along the lengthwise axis Z during the kneading displacement from the wide state to the narrow state. This can create in a massage gripping action on the user' body.

As shown in FIGS. 11A-11F, the kneading displacement from the wide state to the narrow state may be performed in one of two directions: a first direction in which the upper contact member 134 of each massage arm 126 respectively moves along the upper path portion U from the wide to narrow state, and a second direction in which the upper contact member 134 of each massage arm 126 respectively moves along the lower path portion L from the wide to narrow state.

In next step 408, once the narrow state is reached, the two sets of the massage arms 126 and 128 are stopped for a period of time to hold the gripping action. This hold period of time may be a few seconds, e.g., 1, 2 or 3 seconds.

In next step 410, once the hold period of time elapses, the kneading drive mechanism 140 can drive the massage arms 126 and 128 to move from the narrow state back to the wide state for releasing the massage gripping action. During this release displacement, the contact members 134 and 136 in each set of the massage arms 126 and 128 can move away from each other. In one embodiment, the massage arms 126 and 128 can perform a continuous kneading displacement from the narrow state to the wide state to release the massage gripping action. For example, the rotary shaft 144 can rotate continuously in a first direction from the wide state to the narrow state to apply the massage gripping action, and then rotate continuously in an opposite second direction from the narrow state to the wide state to release the massage grip action. In another embodiment, the massage arms 126 and 128 may also perform a plurality of kneading pulses from the narrow state to the wide state to release the massage grip action as described previously.

Advantages of the systems and methods described herein include the ability to apply massage grip actions that can effectively relieve stress and pain for different regions of the body, such as a shoulder area. As a result, a user can enjoy enhanced massage experience and obtain effective relief of muscular tension and pain.

Realizations of the systems and methods have been described only in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the inventions as defined in the claims that follow.

What is claimed is:

1. A method of driving a massage chair, wherein the massage chair includes a backrest, and a first set and second set of massage arms assembled with the backrest and spaced apart from each other along a transversal axis of the backrest, each of the first set and second set of massage arms including a first and a second massage arm that respectively have a first contact member that is movable relative to a second contact member, the method comprising:

positioning the first set and second set of massage arms such that at least the first contact members of the first massage arms contact a desired region of a user's body;

setting the first set and second set of the massage arms in a wide state, the wide state being a state in which the first contact member of the first set of massage arms is transversally spaced apart from the first contact member of the second set of massage arms by a first distance; and actuating the first set and second set of massage arms to perform a sequence of successive kneading pulses in a course of moving the first contact members from the wide state to a narrow state, the narrow state being a state in which the first contact member of the first set of massage arms is transversally spaced apart from the first contact member of the second set of massage arms by a second distance smaller than the first distance, wherein during the movement from the wide state to the narrow state:

the first contact member of the first set of massage arms gradually progresses toward the first contact member of the second set of massage arms at each kneading pulse;

the second contact member of the first set of massage arms remains stationary relative to the second contact member of the second set of massage arms at each kneading pulse;

two successive kneading pulses are timely separated by a hold interval during which the first set and second set of massage arms remain stationary;

applying a gripping action on the user's body when the first set and second set of massage arms reach the narrow state; and stopping the first set and second set of massage arms and the first contact members of the first set and second set of massage arms in the narrow state for a period of time to maintain the gripping action on the user's body.

2. The method according to claim 1, wherein each of the kneading pulses has a pulse duration, the pulse duration being shorter than the hold interval.

3. The method according to claim 1, wherein each of the kneading pulses has a pulse duration less than 1 second.

4. The method according to claim 1, wherein the first contact member of each of the first massage arms is respectively movable along a closed path having an upper and lower path portions, and the step of actuating the first set and second set of massage arms to perform a sequence of successive kneading pulses from the wide state to a narrow state causes the first contact member of each of the first massage arms to move along the upper path portion.

5. The method according to claim 1, wherein the first contact member of each of the first massage arms is respectively movable along a closed path having an upper and lower path portions, and the step of actuating the first set and second set of massage arms to perform a sequence of successive kneading pulses from the wide state to a narrow state causes the first contact member of each of the first massage arms to move along the lower path portion.

6. The method according to claim 1, further including:

driving the first set and second set of massage arms in movement from the narrow state to the wide state to release the gripping action.

7. The method according to claim 6, wherein the step of driving the first set and second set of massage arms in movement from the narrow state to the wide state to release the gripping action includes:

actuating the first and second massage arms to perform a plurality of second kneading pulses from the narrow state to the wide state.

8. The method according to claim 6, wherein the step of driving the first set and second set of massage arms in movement from the narrow state to the wide state to release the gripping action includes:

actuating the first set and second set of massage arms to perform a continuous kneading displacement from the narrow state to the wide state.

9. The method according to claim 1, wherein the step of positioning the first set and second set of massage arms such that at least the first contact members of the first massage arms contact a region of a user's body includes:

positioning the first set and second set of massage arms such that the first contact members contact with an upper shoulder area.

10. The method according to claim 1, wherein actuating the first and second set of massage arms to perform a sequence of successive kneading pulses comprises actuating the first and second set of massage arms to perform two to five kneading pulses in the course of moving the first contact members from the wide state to the narrow state.

11. A massage chair comprising:

a backrest;

a first set and second set of massage arms assembled with the backrest and spaced apart from each other along a transversal axis of the backrest, each of the first set and second set of massage arms including a first massage arm movable relative to a second massage arm, wherein each of the first and second massage arms of the first set and second set of massage arms have a first and a second contact member; and a microcontroller operable to actuate the first set and second set of massage arms, wherein the microcontroller is configured to:

position the first set and second set of massage arms such that at least the first contact members of the first massage arms contact with a desired region of a user's body;

set the first set and second set of massage arms in a wide state, the wide state being a state in which the first contact member of the first set of massage arms are transversally spaced apart from the first contact member of the second set of massage arms by a first distance;

actuate the first and second massage arms to perform a sequence of successive kneading pulses in a course of moving the first contact members from the wide state to a narrow state, the narrow state being a state in which the first contact member of the first set of massage arms is transversally spaced apart from the first contact member of the second set of massage arms by a second distance smaller than the first distance, wherein the first contact member of the first set of massage arms gradually progresses toward the first contact member of the second set of massage arms at each kneading pulse, wherein the second contact member of the first set of massage arms remains stationary relative to the second contact member of the second set of massage arms at each kneading pulse, and wherein two successive kneading pulses are timely separated by a hold interval during which the first set and second set of massage arms remain stationary;

apply a gripping action on the user's body when the first set and second set of massage arms reach the narrow state; and stop the first set and second set of massage arms and the first contact member of the first set and second set of massage arms in the narrow state for a period of time to maintain the gripping action on the user's body.

12. The massage chair according to claim 11, wherein each of the kneading pulses has a pulse duration, the pulse duration being shorter than the hold interval.

13. The massage chair according to claim 11, wherein each of the kneading pulses has a pulse duration less than 1 second.

14. The massage chair according to claim 11, wherein the first contact member of each of the first massage arms is respectively movable along a closed path having an upper and lower path portions, and the first contact member of each of the first massage arms moves along the upper path portion during displacement of the first set and second set of massage arms from the wide state to the narrow state.

15. The massage chair according to claim 11, wherein the first contact member of each of the first massage arms is respectively movable along a closed path having an upper and lower path portions, and the first contact member of each of the first massage arms moves along the lower path portion during displacement of the first set and second set of massage arms from the wide state to the narrow state.

16. The massage chair according to claim 11, wherein the microcontroller is further configured to:

drive the first set and second set of massage arms in movement from the narrow state to the wide state to release the gripping action.

17. The massage chair according to claim 16, wherein the microcontroller is configured to actuate the first and second massage arms to perform a plurality of second kneading pulses from the narrow state to the wide state to release the gripping action.

18. The massage chair according to claim 16, wherein the microcontroller is configured to actuate the first set and second set of massage arms to perform a continuous kneading displacement from the narrow state to the wide state to release the gripping action.

19. The massage chair according to claim 11 wherein the microcontroller is configured to actuate the first set and second set of massage arms to perform a sequence of two to five kneading pulses in the course of moving the first contact members from the wide state to the narrow state.

* * * * *